US006763862B2

(12) United States Patent
Fontenot et al.

(10) Patent No.: US 6,763,862 B2
(45) Date of Patent: Jul. 20, 2004

(54) SUBMERGED FLOWLINE TERMINATION AT A SINGLE POINT MOORING BUOY

(75) Inventors: William L. Fontenot, Houston, TX (US); Charles A. Zimmermann, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/289,515

(22) Filed: Nov. 6, 2002

(65) Prior Publication Data

US 2003/0084961 A1 May 8, 2003

Related U.S. Application Data

(60) Provisional application No. 60/332,782, filed on Nov. 6, 2001.

(51) Int. Cl.[7] ..... B65B 1/04; B63B 22/02

(52) U.S. Cl. ..... 141/387; 141/388; 441/3; 441/5

(58) Field of Search ..... 141/387, 388, 141/279, 382; 441/3, 4, 5

(56) References Cited

U.S. PATENT DOCUMENTS

| | | | | |
|---|---|---|---|---|
| 4,423,984 A | | 1/1984 | Panicker et al. | 405/195 |
| 4,793,737 A | | 12/1988 | Shotbolt | 405/169 |
| 5,639,187 A | | 6/1997 | Mungall et al. | 405/195.1 |
| 5,816,182 A | * | 10/1998 | Pollack | 114/293 |
| 5,816,183 A | | 10/1998 | Braud et al. | 114/230 |
| 5,944,448 A | * | 8/1999 | Williams | 441/3 |
| 6,109,833 A | | 8/2000 | Savy | 405/195.1 |
| 6,109,989 A | | 8/2000 | Kelm et al. | 441/4 |
| 6,206,742 B1 | | 3/2001 | Bull et al. | 441/1 |
| 6,406,222 B1 | * | 6/2002 | Pollack | 405/224 |
| 6,415,828 B1 | * | 7/2002 | Duggal et al. | 141/387 |
| 6,517,291 B1 | * | 2/2003 | Pollack | 405/224 |

FOREIGN PATENT DOCUMENTS

GB 2335723 A 9/1999

OTHER PUBLICATIONS

US 2002/0177375 A1; Cottrell et al.; Pub. Date: Nov. 18, 2002.*

* cited by examiner

*Primary Examiner*—David A. Scherbel
*Assistant Examiner*—Khoa D. Huynh
(74) *Attorney, Agent, or Firm*—Gary L. Bush; Andrews Kurth LLP

(57) ABSTRACT

A submerged connection assembly for connecting an end of a pipeline to a flexible hose that runs to a SPM buoy including an elastic suspension arrangement between the SPM buoy and the connection assembly.

6 Claims, 3 Drawing Sheets

SUBMERGED FLOWLINE TERMINATION AT A SINGLE POINT MOORING BUOY

CROSS REFERENCE TO RELATED APPLICATION

This application claims priority from provisional application No. 60/332,782 filed Nov. 6, 2001.

BACKGROUND OF THE INVENTION

1. Field of the Invention

This invention relates generally to an offshore loading system such as a CALM or SALM which serves as a single point mooring (SPM) for a shuttle tanker or the like and a product transfer system for transferring hydrocarbon product via an associated product flowline arrangement between a production and/or storage facility such as a platform or FPSO and the SPM to the shuttle tanker.

2. Description of Prior Art

In deep water operations, certain operational considerations make it desirable to offload hydrocarbons from a production and/or storage facility by running a pipeline to an offshore loading system, such as a CALM or SALM (i.e., a SPM buoy) buoy, where a shuttle tanker may be moored and connected to a loading hose for filling its tanks with crude oil. Deep water installations, e.g., in depths greater than about 1000 feet, require that the pipeline be suspended between the production and/or storage facilities, such as a platform or FPSO and the SPM buoy rather than running the pipeline along the sea bed. The pipeline must be submerged at a depth deep enough so as not to interfere with shuttle tanker traffic. A problem exists in connecting the end of the pipeline directly to the SPM buoy, because as the buoy moves up and down and side to side, the end of the pipeline moves with it, and as a result is subject to fatigue failure. The term "pipeline" includes steel tubular pipelines as well as bonded and unbonded flexible flowlines fabricated of composite materials.

The problem identified above is inherent in prior offloading deep water SPM buoys which have pipelines attached directly to and supported from a CALM buoy for example. The pipelines are directly coupled to the CALM buoy such that motions of the CALM buoy are also directly coupled to the pipeline with resulting fatigue damage. Prior systems such as that described in U.S. Pat. No. 5,639,187 (Mungall, et al) have provided a hybrid flowline including rigid (e.g., steel catenary risers) pipelines on the seabed from subsea wells combined with flexible flowlines (e.g., marine hoses) at a submerged buoy which is moored to the seabed by tension leg tether legs. The buoy is positioned at a depth below the turbulence zone of the water. Flexible hoses are fluidly connected to the steel catenary risers at the submerged buoy and extend upward through the turbulence zone to the surface. Similar arrangements are disclosed in U.S. Pat. No. 6,206,742 (Bull, et al), U.S. Pat. No. 6,109,833 (Savy), U.S. Pat. No. 4,793,737 (Shotbolt) and U.S. Pat. No. 4,423,984 (Paniker, et al).

Another prior system, described in U.S. Pat. No. 6,109,989 (Kelm, et al) shows a submerged pipeline and manifold (SPLEM) supported by chains from a CALM buoy. Product flow lines run from the SPLEM to the CALM buoy and fluidly connect with steel pipelines between the SPLEM and a storage facility. The SPLEM support by chains causes it to move vertically with the surge motion of the CALM buoy.

Another prior system, described in U.S. Pat. No. 5,816,183 (Brand, et al), shows a submerged CALM buoy to which steel pipelines are directly terminated. The submerged CALM buoy, although beneath the dynamic zone of the sea and thereby isolates the steel pipeline connection to the CALM from substantial vertical motion, nevertheless is disadvantageous in that a submerged product swivel is required.

Another prior system, described in British Patent GB 2335723 B (de Baan), attempts to solve the problem identified above by suspending the end of a rigid steel tubular flowline (e.g., the pipeline) by a chain from the offloading buoy and fluidly connecting a flexible hose to the end of the rigid steel flowline below the turbulence zone of the sea. While eliminating a certain level of coupling of wave induced forces to the end of the rigid steel flowline which extends from a production and/or storage facility (FPSO or platform), nevertheless, a sufficient degree of coupling still exists to create a fatigue problem, and possible failure, for the pipeline.

Identification of Objects of the Invention

A primary object of the invention is to provide a product transfer system from a FPSO or platform via a pipeline (either rigid or flexible) to a mooring and transfer buoy such as a CALM or SALM and then to a shuttle tanker while substantially eliminating coupling of wave induced motions of the buoy with the end of the pipeline.

Another object of the invention is to provide a conventional SALM or CALM buoy which provides support for a termination coupling between a steel pipeline and a flexible hose for decoupling the end of the steel pipeline from wave induced motions of the SALM or CALM buoy.

Another object of this invention is to provide a support arrangement for a submerged pipeline and its coupling to a flexible hose that substantially isolates CALM or SALM vertical motions from the end of the pipeline.

Another object of the invention is to provide a conventional CALM buoy for the product transfer system on which an above-water product swivel is placed so that in-situ servicing of the swivel and SALM or CALM buoy can be conducted.

Another object of the invention is to provide an offshore product transfer system that is suitable for use with large diameter, submerged, rigid (e.g., steel) or flexible (e.g., composite) pipelines in deep water.

Another object of the invention is to provide a product transfer system which decouples a submerged pipeline from a surface offloading buoy and its wave induced motions, thereby reducing fatigue damage to the pipeline.

Another object of the invention is to provide a product transfer arrangement that allows for optimizing of pipeline diameter and buoyancy, because improved fatigue resistance allows for greater variability in the configuration of the submerged pipeline.

Another object of the invention is to support a flowline in a way that decouples the SALM or CALM buoy from the flowline with a resulting low fatigue damage to the flowline at the lowest practical cost.

Another object of the invention is to provide a product transfer system that meets the objects described above while employing a conventional surface offloading mooring and hydrocarbon transfer terminal such as a SALM or CALM.

SUMMARY OF THE INVENTION

The objects identified above along with other advantages and features are provided in the invention embodied in a product transfer system by which a rigid or flexible pipeline from a FPSO or platform or the like extends in the sea above the seabed for about a nautical mile where it terminates close to and below a SALM or a CALM buoy, and where it is fluidly coupled to a flexible hose at a coupling arrangement. The coupling is supported by the SALM or CALM below the wave kinematics zone by an elastic flowline mooring leg or motion compensator. The elastic flowline mooring leg extends generally vertically downward from the SALM or CALM buoy and is anchored at its lower end at a short distance from the connector. A flexible member such as a chain is connected between the lower end of the vertical elastic mooring leg and the connector. The elastic mooring leg reduces the coupling of the vertical motion of the SALM or CALM buoy to the pipeline end.

The other end of the flexible hose is coupled to the stationary inlet of a product swivel mounted on a stationary portion of the SPM offloading buoy. A shuttle tanker is moored to the SPM (SALM or CALM) buoy by a hawser secured to a rotatable portion of the CALM buoy. A hose from a rotatable output of the product swivel extends to the shuttle tanker to complete the product flow path from the (FPSO or platform) to the shuttle tanker.

BRIEF DESCRIPTION OF THE DRAWINGS

The objects, advantages and features of the invention will become more apparent by reference to the drawings which are appended hereto and wherein an illustrative embodiment of the invention is shown, of which.

DETAILED DESCRIPTION OF THE PREFERRED EMBODIMENT OF THE INVENTION

The mooring and fluid transfer arrangement of this invention generally concerns deep water hydrocarbon offloading from offshore production platforms, either fixed (e.g., Jacket structures), or floating (e.g., FPSOs, Semi-submersibles, or Spars). Conventional offloading arrangements provide a single offloading buoy located approximately two kilometers away from the platform, with a submerged flexible or steel pipeline(s) connected between them. With the prior arrangements, the surface offloading buoy requires a large displacement to support the submerged pipeline(s) and their product. Because of its size, the offloading buoy is subject to motions in response to the wave environment. These wave-frequency motions are coupled to the pipeline and affect its dynamic response, leading to fatigue damage to the pipeline over time.

The connector arrangement of this invention between a pipeline and a flexible hose is supported by an elastic coupling which effectively eliminates the fatigue damage to one or more pipelines by decoupling the motion of the surface offloading buoy from the pipelines.

The connector arrangement includes an elastic tether, made of polyester or another elastic material, that is connected to the bottom of the SPM buoy. The lower end of the tether is anchored to the sea floor. A chain or other tension member extends from the lower end of the tether to the connector between the pipeline and the flexible hose. The connector arrangement is placed below the wave zone of the sea. Because the connector arrangement is effectively below the range of wave kinematics, and because the elastic tether isolates SPM buoy vertical motions from the connector, the connector does not exhibit significant response to the wave field, thus reducing fatigue damage to the end of the pipeline. Offloading to a shuttle tanker is performed through the SALM or CALM buoy system, which is anchored to the sea floor respectively by a single anchor leg or a plurality of catenary anchor legs. A standard marine hose or flexible hose connects the SALM or CALM buoy to the pipeline at the connector.

Figure 1:
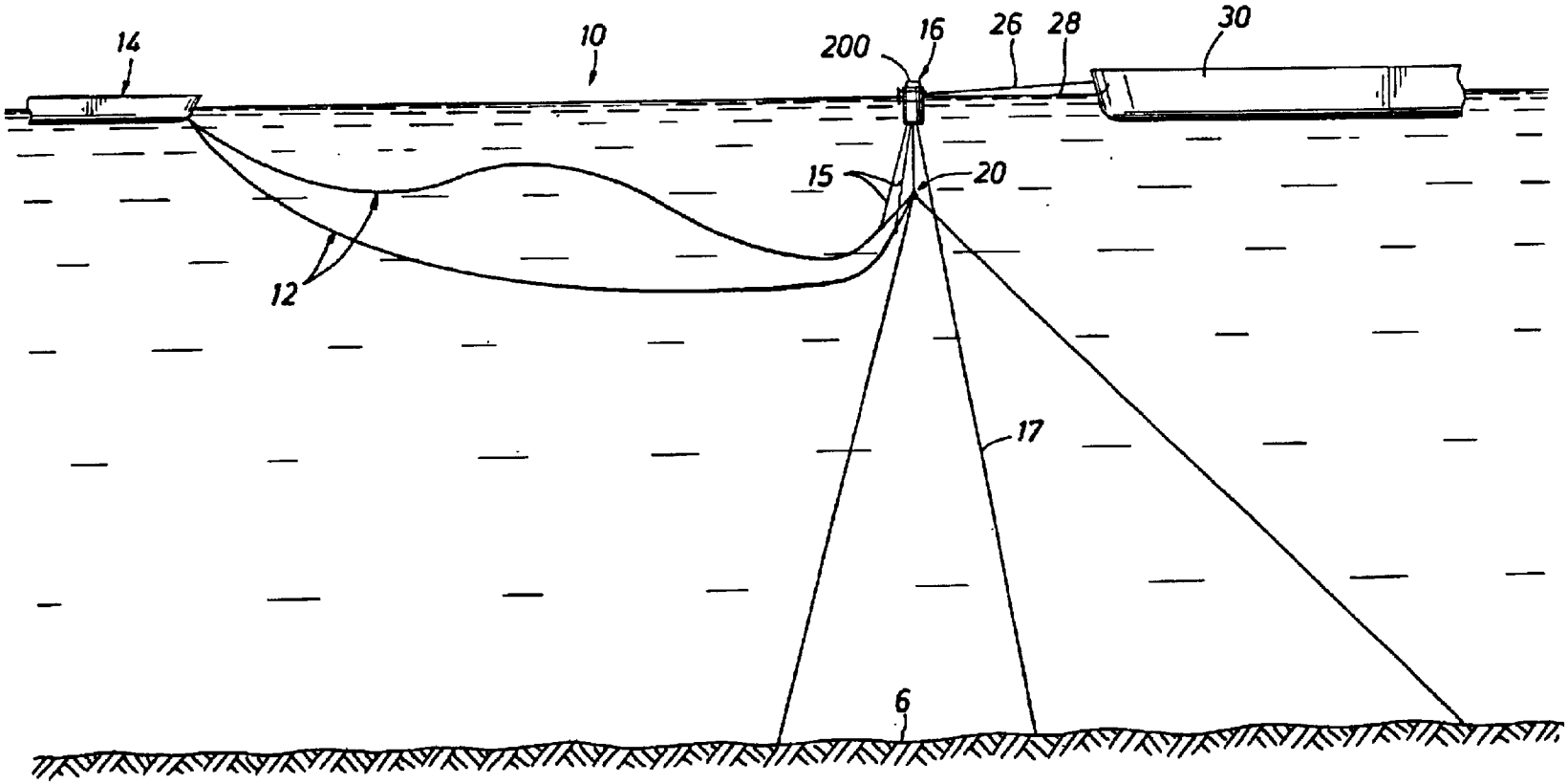
FIG. 1 is a schematic illustration of an arrangement of the invention where an end of a rigid or flexible pipeline from a FPSO or production platform is supported by a submerged connector arrangement which is supported from a single point mooring offloading buoy such as a SALM, with a flexible marine hose fluidly connected between the end of the pipeline and a stationary inlet of a product swivel mounted on the SALM.
Figure 2:
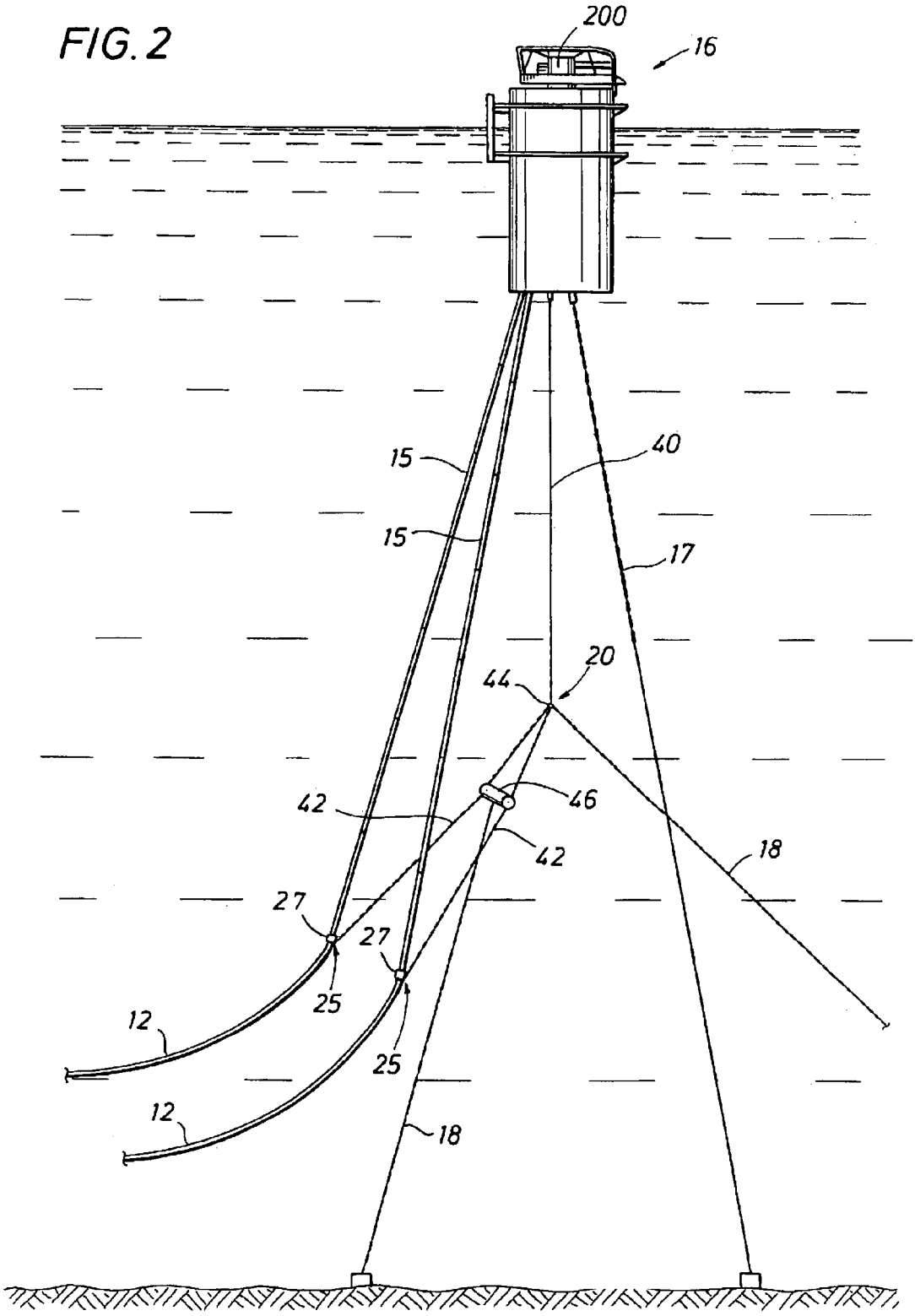
FIG. 2 is a schematic illustration showing more detail of the suspension of the support arrangement including an elastic tether between the SALM and the connector arrangement.
Figure 3:
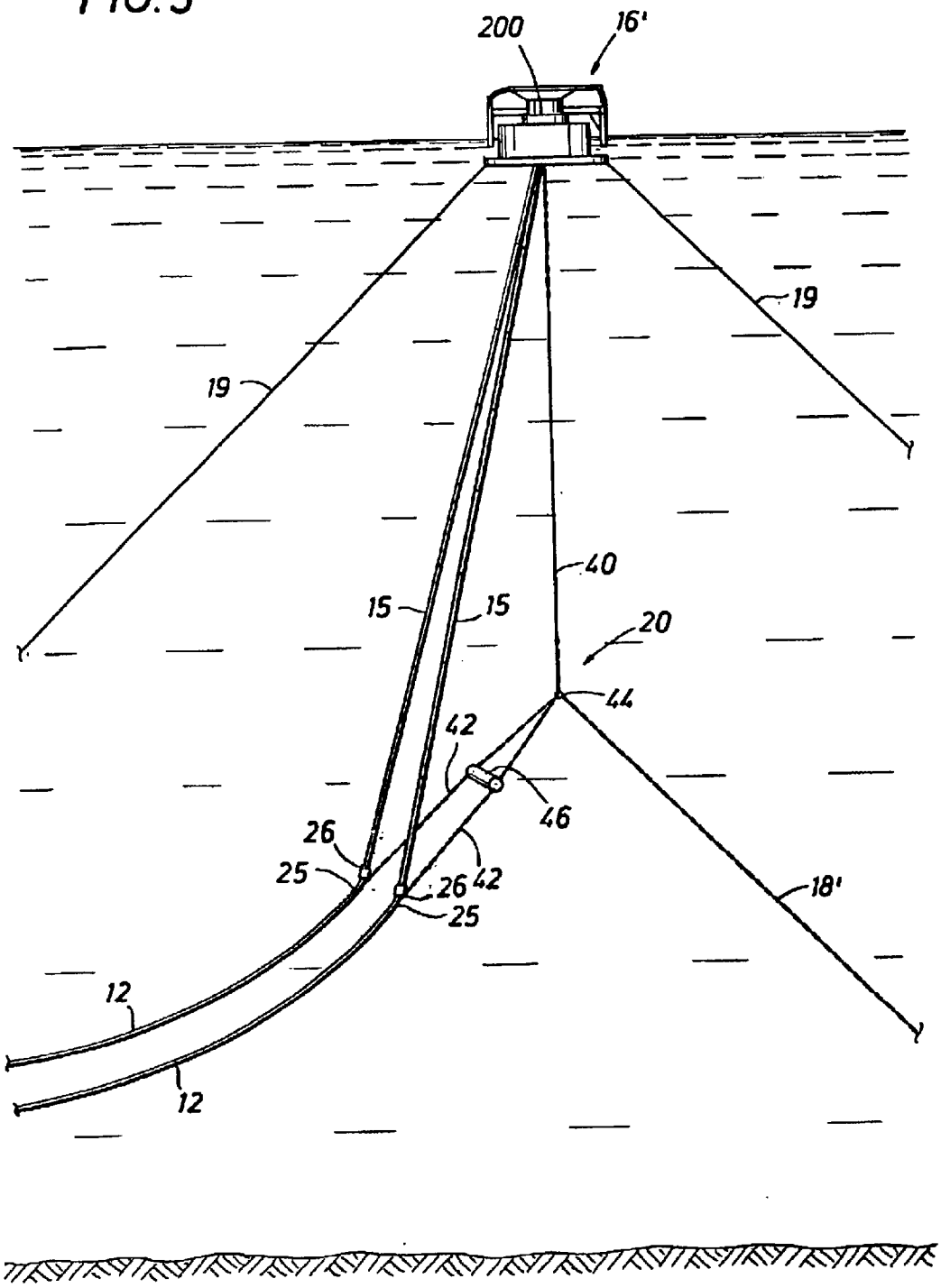
FIG. 3 is an illustration similar to that of FIG. 2, but with a CALM provided as the SPM buoy.

FIG. 1 shows the general arrangement 10 of the invention where one or more pipelines 12 are fluidly connected between a FPSO or platform 14 to a deep water SALM buoy 16 (or CALM buoy 16' as shown in FIG. 3) via an elastic suspension arrangement 20. A pipeline (or multiple pipelines) 12 may have buoyancy modules (not illustrated) attached along the run of the pipeline 12 between the FPSO 14 and SPM buoy 16 and may achieve different depth profiles (as suggested by the illustration of FIG. 1) as a function of distance from the FPSO 14, if desired. Marine hoses or flexible flowlines 15 are fluidly connected to the pipelines 12 at connector assemblies 25 (See FIGS. 2 and 3), and a product swivel 200 of the SALM 16 or CALM 16'. As schematically illustrated in FIG. 1, a shuttle tanker 30 is conventionally moored by mooring hawser 26 to the SALM 16 (FIG. 2) or CALM 16' (FIG. 3) and is conventionally fluidly connected by flowline 28 to the fluid swivel 200.

The elastic suspension arrangement 20 of FIG. 2 includes an elastic tether 40 constructed of polyester or other elastic material. Flexible tension members (such as chains) 42 are connected between the lower end 44 of member 40 and the connector assembly 25 which couples ends of pipelines 12 to lower ends of flexible hoses 15. Anchor legs such as chains 18 are connected either to the end 44 of elastic tether 40 or to a spreader bar 46 for substantially fixing the vertical position of end 44 and as a result the position of connector assemblies 25. A single taut anchor leg 17 moors SALM 16 of FIG. 2, while multiple catenary anchor legs 19 moor CALM 16' in conventional ways. A single anchor leg 18' as illustrated in FIG. 3 may suffice with the result that a secured anchor leg 18 between chains 42 or spreader bar 46 of FIG. 2 may be eliminated.

The connector assemblies 25 are preferably gooseneck members with bull valves 27 mounted in the flow path between the gooseneck and the flexible hoses 15. Such connector assemblies are described in U.S. Pat. No. 6,415,828 B1 which is incorporated herein by reference.

The pipelines 12, preferably steel tubular members which have flotation attached to them along their path from FPSO 14 to the FTB 16 to prevent excessive sagging due to their heavy weight, do not touch the sea floor. They typically run at least one nautical mile to the vicinity of the SALM or CALM offloading buoy, but are submerged beneath the sea surface at a depth so that shuttle tankers 30 (as shown in FIG. 1) can maneuver between the FPSO 14 and the SALM or CALM buoy without fear of fouling the pipelines 12. Steel pipelines are rigid in the sense that they are continuous steel tubular members, but of course such steel pipelines have flexibility due to their great weight and the inherent flexibility of a long spaghetti-like steel tubular string.

The preferred embodiment of elastic tether 40 is to construct it entirely of an elastic material so that the vertical motion of the SALM 16 or CALM 16' is generally isolated from the end 44 of the member 40. Other arrangements are equivalents to a single elastic tether. For example, a series connected spring-chain arrangement can be provided. A motion compensator (not illustrated) mounted on the SPM can be provided to reduce not only the vertical but also the horizontal motions of the pipelines.

The elastic suspension arrangement 20 can be modified from that shown in FIGS. 2 and 3. For example, a spreader bar could be provided between the connector assemblies 25 and a vertical elastic tether and an anchor leg provided for each flow line 12.

What is claimed is:

1. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged connection assembly connecting an end of said pipeline to a flexible hose which is fluidly connected to said product swivel, and an elastic suspension arrangement including an elastic member coupled between said single point mooring facility and said submerged connection assembly wherein, said elastic member is an elastic tether coupled at an upper end to said single point mooring facility, said tether having a lower end, said suspension arrangement includes an anchor leg connected between said lower end of said tether and a sea floor, and a flexible member connected between said lower end of said elastic tether and said submerged connection assembly, first and second pipelines are provided between said hydrocarbon facility, and first and second submerged connection assemblies couple respectively first and second hose members to ends of said first and second pipelines, with said first and second flexible hose members fluidly connected to said product swivel, and said elastic suspension arrangement includes first and second flexible members connected respectively between said lower end of said elastic tether and said first and second submerged connection members, and a spreader bar is connected between said first and second flexible members, and an anchor lea is connected between said spreader bar and said sea floor.

2. The arrangement of claim 1 wherein, said single point mooring facility is a SALM buoy with a single anchor leg connected between said SALM buoy and said sea floor.

3. The arrangement of claim 1 wherein, said single point mooring facility is a CALM buoy with catenary anchor legs connected between said CALM buoy and said sea floor.

4. The arrangement of claim 1 further comprising, a second anchor leg coupled between said flexible member and said sea floor.

5. The arrangement of claim 1 wherein, said submerged connection assemblies include gooseneck fluid flow conduits and ball valves which fluidly connect said ends of said pipelines to said flexible hoses.

6. The arrangement of claim 1 wherein, said elastic tether includes an element which is characterized by resilient properties.

* * * * *

UNITED STATES PATENT AND TRADEMARK OFFICE

CERTIFICATE OF CORRECTION

PATENT NO. : 6,763,862 B2 
DATED : July 20, 2004
INVENTOR(S) : William L. Fontenot et al.

It is certified that error appears in the above-identified patent and that said Letters Patent is hereby corrected as shown below:

Column 6,
Line 13, delete the word "lea" and insert -- leg --

Signed and Sealed this

Seventh Day of December, 2004

JON W. DUDAS
*Director of the United States Patent and Trademark Office*